US007118046B2

(12) United States Patent
Yoshimura et al.

(10) Patent No.: US 7,118,046 B2
(45) Date of Patent: Oct. 10, 2006

(54) SLIDING STRUCTURE FOR SHAFT MEMBER WITH IMPROVED ABRASION RESISTANCE AND INJECTOR

(75) Inventors: Tetsuya Yoshimura, Toyota (JP); Shuichi Matsumoto, Kariya (JP)

(73) Assignee: Denso Corporation, (JP)

( * ) Notice: Subject to any disclaimer, the term of this patent is extended or adjusted under 35 U.S.C. 154(b) by 141 days.

(21) Appl. No.: 10/759,106

(22) Filed: Jan. 20, 2004

(65) Prior Publication Data

US 2004/0144868 A1 Jul. 29, 2004

(30) Foreign Application Priority Data

Jan. 23, 2003 (JP) ..... 2003-014882

(51) Int. Cl.
*F02M 41/16* (2006.01)

(52) U.S. Cl. ..... 239/96; 239/102.2; 239/533.9; 239/533.11; 251/355; 384/15; 384/16; 277/412; 277/413

(58) Field of Classification Search ..... 239/96, 239/102.2, 533.4, 533.9, 533.11; 251/355; 384/15, 16, 32; 277/412, 418
See application file for complete search history.

(56) References Cited

U.S. PATENT DOCUMENTS

| | | | | |
|---|---|---|---|---|
| 3,721,163 | A * | 3/1973 | Hill et al. | 92/158 |
| 4,304,410 | A * | 12/1981 | Erickson et al. | 277/412 |
| 4,889,039 | A * | 12/1989 | Miller | 92/140 |
| 5,140,905 | A * | 8/1992 | Dhar | 92/82 |
| 6,283,389 | B1 * | 9/2001 | Hofmann | 239/533.11 |
| 6,547,534 | B1 * | 4/2003 | Sakamoto et al. | 417/244 |
| 6,817,542 | B1 * | 11/2004 | Boecking | 239/102.1 |
| 2004/0079818 | A1 | 4/2004 | Lindner et al | |

FOREIGN PATENT DOCUMENTS

| | | |
|---|---|---|
| DE | 19820264 A1 | 11/1999 |
| DE | 10102234 A1 | 7/2002 |
| EP | 1026393 A | 8/2000 |
| EP | 1156209 A | 11/2001 |
| GB | 1326306 | 8/1973 |
| JP | 7-103106 | 4/1995 |

(Continued)

OTHER PUBLICATIONS

Patent Abstracts of Japan, vol. 1995, No. 07, Aug. 31, 1995 & JP 07 103106A (HINO MOTORS LTD), Apr. 18, 1995 with English Abstract.

(Continued)

*Primary Examiner*—David A. Scherbel
*Assistant Examiner*—Jason Boeckmann
(74) *Attorney, Agent, or Firm*—Nixon & Vanderhye PC

(57) ABSTRACT

In a sliding structure in which a shaft member is retained slidably in a guide hole, the lack of an oil film caused by the edge contact of the shaft member to which a pressing load in the axial direction is applied is prevented. With the fact being taken into account that end portions 25*c*1 and 25*c*2, which are always in slidable contact with a side surface 1232*a* of a guide hole 1232, of a side surface 25*c* of a shaft member 251 are the partial edge portion, a plurality of labyrinth grooves 2501 and 2502 are formed in the end portions 25*c*1 and 25*c*2, respectively, thereby it is possible for an oil film to cover the entire contact portion without increasing the groove width extremely. Because the groove width is not increased extremely, the length of the sliding portions can be ensured.

15 Claims, 5 Drawing Sheets

FOREIGN PATENT DOCUMENTS

| | | |
|---|---|---|
| JP | 2000-337222 | 12/2000 |
| JP | 2001-280223 | 10/2001 |
| JP | 2002-202023 | 7/2002 |
| JP | 2002-295342 | 10/2002 |
| WO | WO 03/004865 | 1/2003 |

OTHER PUBLICATIONS

Patent Abstracts of Japan, vol. 2002, No. 02, Apr. 02, 2002, & JP 2001 280223 A (DENSO CORP.), Oct. 19, 2001 with English Abstract.

Japanese Official Action dated Jul. 4, 2006 issued in foreign counterpart Japanese Application 2003- 014882 and translation.

* cited by examiner

SLIDING STRUCTURE FOR SHAFT MEMBER WITH IMPROVED ABRASION RESISTANCE AND INJECTOR

BACKGROUND OF THE INVENTION

1. Field of the Invention

The present invention relates to a sliding structure for a shaft member and an injector.

2. Description of the Related Art

A sliding structure in which a shaft member is retained slidably in a guide hole is used in various kinds of equipment, and an injector making up a fuel injection device in an internal combustion engine is an example of such equipment. An injector switches between fuel injection and termination of the injection, for example, by axially displacing a needle made up of a shaft member and inserted into a nozzle to which a fuel for injection is supplied. In this case, the injector has a sliding structure in which the needle is retained slidably in a guide hole. The needle opens a valve, for example, when the fuel pressure in the nozzle, which always acts in the direction to open the valve, exceeds the spring force of a spring which specifies a pressure to open the valve.

There is another example of a structure, such as an injector used in a common rail type fuel injection device, in which the back pressure of the needle is switched between the high-pressure side and the low-pressure side in order to activate the needle. Such an injector has a sliding structure in which a valve chamber, provided with a valve body for isolating a back pressure chamber from a low pressure source, is provided on the way in a flow path for releasing the high-pressure fuel to be introduced into the back pressure chamber which generates a back pressure, to the low pressure source and a piston for pressing the valve body is retained in a guide hole penetrating through the wall of the valve chamber. The piston is pressed and driven by an actuator made up of a piezo stack or the like, the isolation between the back pressure chamber and the low pressure source is cancelled by displacing the valve body, and the back chamber is open to a low pressure.

In the cases of these injectors, part of fuel penetrates into the gap between the side surface of the shaft member and the side surface of the guide hole and forms an oil film therein and, therefore, the slidability is improved because of the reduction in sliding friction, but a leak of fuel from the sliding portion (leak of the sliding portion) reduces the force of the needle to open the valve and the generated oil pressure and, therefore, it is necessary to sufficiently ensure the sealing ability against the fuel leak as well as maintaining the slidability and only a clearance as narrow as several μm is allowable between the side surface of the guide hole and the side surface of the needle which are in slidable contact with each other. Because of this, there is an attempt in which labyrinth grooves are formed in the side surface of a needle to prevent the lack of an oil film and capture foreign matter in a fuel (see Patent document 1, etc.)

There is another attempt, in which the unevenness of the slidability and the sealing ability is improved by increasing the intervals at which grooves are arranged so that the interval on the low-pressure side is longer than that on the high-pressure side and the interval on the central portion is longer than that on the low-pressure side, with it being taken into account that the inner diameter of a guide hole is most enlarged and deformed on the high-pressure side thereof and the clearance becomes relatively large, whereas the degree of enlargement and deformation is small on the central portion of the guide hole, because a large slope of pressure is produced in the direction of the guide hole in a device such as the above-mentioned common rail type fuel injection device, in which a high-pressure fuel is supplied to the inside of a nozzle body (see Patent document, etc.).

[Patent Document 1]

Japanese unexamined Patent Publication (Kokai) No. 7-103106

[Patent Document 2]

Japanese unexamined Patent Publication (Kokai) No. 2001-280223

SUMMARY OF THE INVENTION

A fuel pressure acts on the needle from one axial direction and a spring force which specifies a pressure to open a valve and the fuel pressure in the back pressure chamber acts from the other axial direction. Where a piston is pressed and driven by an actuator, the actuator displaces the piston against the fuel pressure and the spring force exerted from one axial direction. In other words, the needle and the piston are displaced in the axial direction under the condition that a pressing load is applied from both end surfaces.

Under such a condition, a couple is likely to act on the shaft member and the shaft member inclines with respect to the axial direction of the guide hole, resulting in an edge contact. Because of this, there is the possibility of an abrasion caused by the lack of an oil film at the contact portion between the side surface of the shaft member and the side surface of the guide hole.

The present invention has been developed with the above-mentioned problems being taken into account, and the object is to provide a sliding structure of a shaft member capable of preventing abrasion due to the lack of an oil film and an injector having the sliding structure of a shaft member.

In a sliding structure of a shaft member according to a first aspect of the present invention, a shaft member is retained slidably in a guide hole and a plurality of labyrinth grooves are formed in both axial end portions of the side surface of the shaft member, respectively, which are located in an area at which a side surface of the shaft member is always in slidable contact with a side surface of the guide hole.

The contact portions between the side surface of the shaft member and the side surface of the guide hole, which are in an edge contact because of the inclination of the shaft member, are located in both end portions of the shaft member at which the side surface of the shaft member is always in slidable contact with the side surface of the guide hole, and the contact portions have a certain length in the axial direction of the guide hole. By forming a plurality of grooves in both end portions, respectively, it is possible to make an oil film cover the entire contact portion having the certain length without increasing the groove width extremely. Because the groove width is not increased extremely, it is possible to ensure the sliding length of the contact portion. Because of this, it is possible to effectively prevent abrasion due to the lack of an oil film and to avoid in advance the adhesion due to the abrasion and the binding of the shaft member due to the occurrence of abrasion powder.

An injector according to a second aspect of the present invention comprises a needle, which is made up of a shaft member, displaced in the axial direction to switch between fuel injection and termination of injection and inserted into a nozzle supplied with a fuel for injection; wherein a structure, in which the needle is retained slidably in a guide hole formed in the nozzle wall, or a structure, in which a valve chamber provided with a valve body for isolating a back pressure chamber from a low-pressure source is provided on the way in a low-pressure flow path for releasing to the low-pressure source the fuel in the back pressure chamber to which a high-pressure fuel is supplied and which generates a back pressure of the needle, and in which a piston which is made up of a shaft member and presses the valve body into the guide hole penetrating through the wall of the valve chamber, is retained has the sliding structure of a shaft member in the first aspect.

A couple is likely to act on the needle and the piston making up the injector and the number of times in which the shaft axially moves is very large, therefore, it is possible to avoid a failure and lengthen the life span by the application of the first aspect of the present invention.

The present invention may be more fully understood from the description of the preferred embodiments of the invention set forth below, together with the accompanying drawings.

DESCRIPTION OF THE PREFERRED EMBODIMENTS

Figure 1:
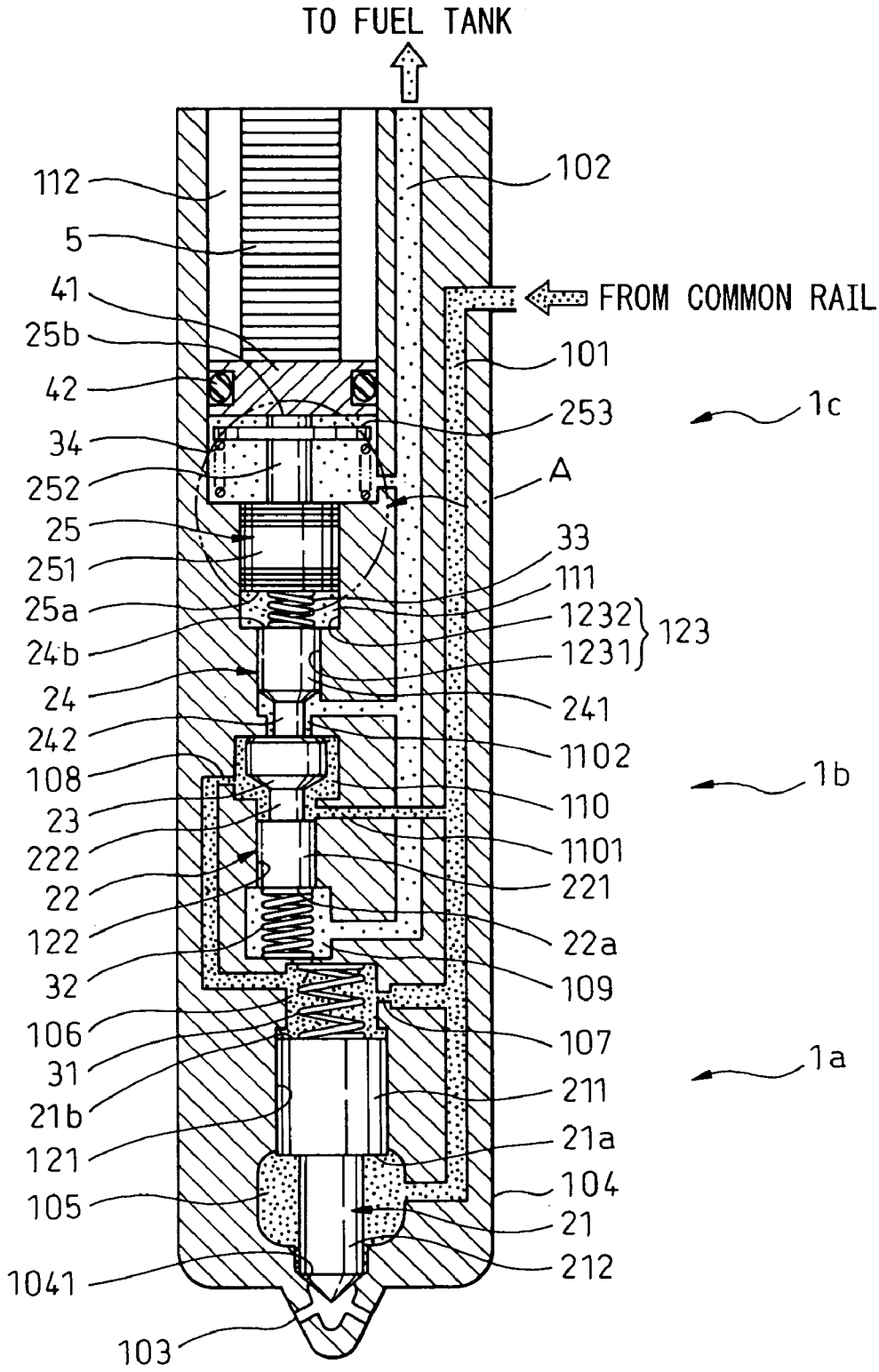
FIG. 1 is a sectional view of an injector to which the present invention is applied.
Figure 2:
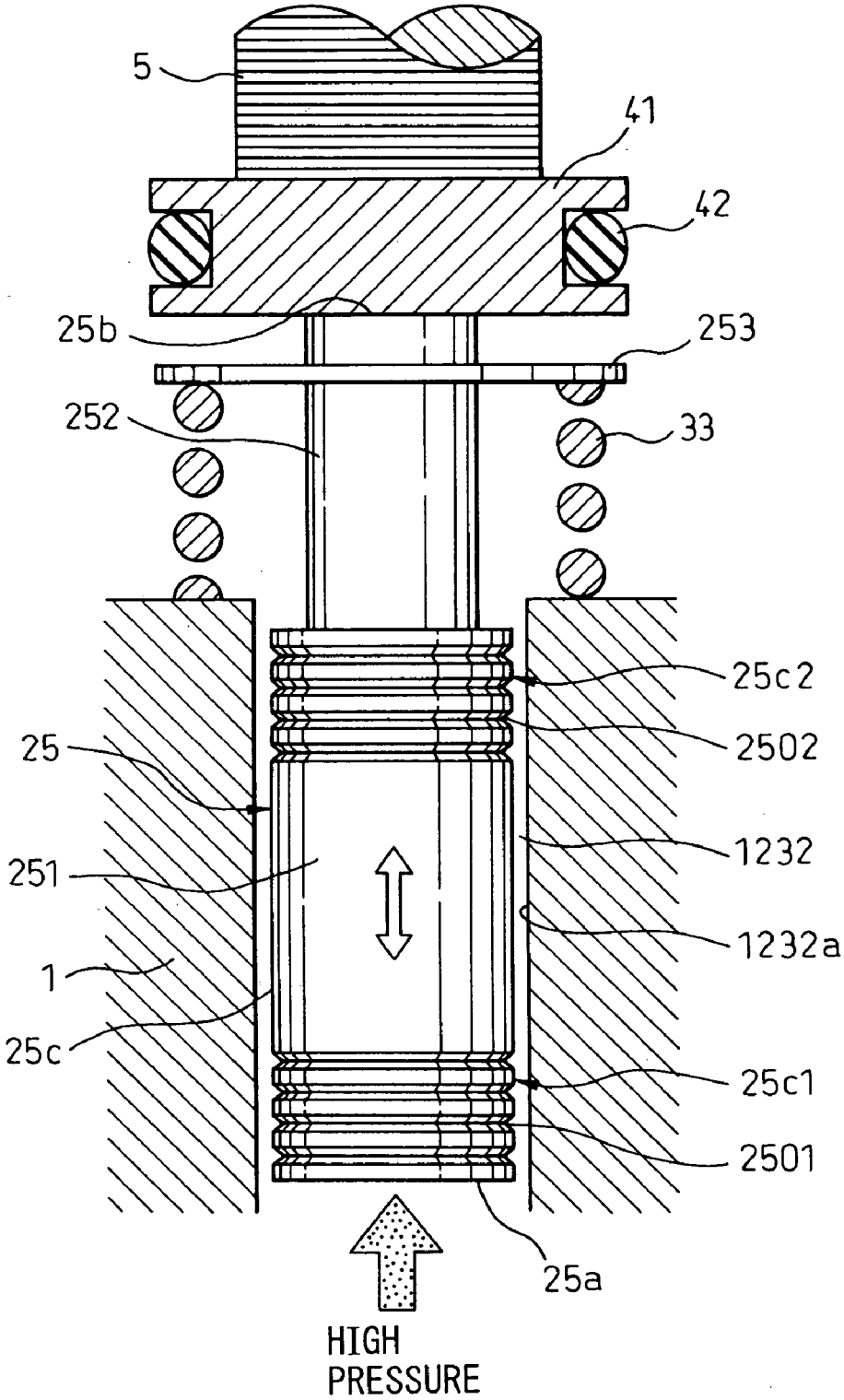
FIG. 2 is an enlarged view of part A in FIG. 1.

FIG. 1 shows the structure of the injector of a common rail type fuel injection device of a diesel engine to which the present invention is applied. The injector is provided to each cylinder of a diesel engine in a one-to-one manner, receives the supply of fuel from a common rail, and injects the fuel into the combustion chamber of each cylinder with an injection pressure substantially equal to the fuel pressure in the common rail (referred to as a common rail pressure, hereinafter). The fuel in a fuel tank is pumped to the common rail by a high-pressure supply pump and stored under high pressure.

The fuel supplied to the injector from the common rail is also used to provide a control oil pressure of the injector as well as being used for injection to the combustion chamber, and flows back from the injector into the low-pressure fuel tank.

The injector has a rod-shaped body 1 in which a plurality of members are combined and is installed in such a way that the lower portion, in the figure, penetrates through the wall of the combustion chamber of the engine, which is not shown, and protrudes into the combustion chamber. The injector includes an injection section 1*a*, a back pressure control section 1*b* and a piezo actuator 1*c* from bottom to top in this order.

In an injection section 1*a*, a needle 21 is arranged in a nozzle 104 at the front end of which injection holes 103 are formed. A proximal end portion 211 of the needle 21 is retained slidably in a guide hole 121 formed in the wall of the nozzle 104, and a front end portion 212 of the needle 21 sits on or lifts from an annular seat 1041 by the axial movement of the needle 21 in the axial direction of the guide hole 121. A high-pressure fuel is supplied to an outer circumferential space 105 around the front end portion 212 of the needle from the common rail through a high-pressure path 101, and the fuel is injected from the injection holes 103 when the needle 21 lifts from the seat. The fuel pressure from the high-pressure path 101 acts on an annular step 21*a* of the needle 21 in the direction in which the needle lifts from the seat (upward direction).

A fuel as a control oil is introduced to the back side of the needle 21 from the high-pressure path 101 via an in-orifice 107 and a back pressure chamber 106 for generating a back pressure on the needle 21 is formed. The back pressure and the force of a spring 31 provided in the back pressure chamber 106 act on a rear end surface 21*b* of the needle 21 in the direction in which the needle sits on the seat (downward direction). The needle rear end surface 21*b* is also in elastic contact with the spring 31 within the back pressure chamber 106 and the spring force acts in the direction in which the needle sits on the seat (downward direction).

The back pressure of the needle 21 is raised or reduced in the back pressure control section 1*b* and the back pressure control section 1*b* is controlled by the piezo actuator 1*c* equipped with a piezo stack 5.

The structure of the back pressure control section 1*b* is as follows. The back pressure chamber 106 always communicates with a valve chamber 110 via an out-orifice 108. The valve chamber 110 is made up of a part of a longitudinal hole with a plurality of steps formed within the injector in the direction of the length and, in the longitudinal hole, in addition to the valve chamber 110, a high-pressure port 1101, a guide hole 122 and a spring chamber 109 are provided in this order below the valve chamber 110, and a low-pressure port 1102, a guide hole 123 and a piezo stack chamber 112 are provided in this order above the valve chamber 110.

The high-pressure port 1101 is open at the bottom surface of the valve chamber 110 and communicates with the high-pressure path 101. The low-pressure port 1102 is open at the top surface of the valve chamber 110 and communicates with a low-pressure path 102. The spring chamber 109 and the piezo stack chamber 112 communicate with the low-pressure path 102.

Within the valve chamber 110, a valve body 23 is arranged. The valve body 23 is made up of a substantially circular member and, when it goes down, the valve chamber 110 is isolated from the high-pressure path 101 because the bottom end portion thereof closes the high-pressure port 1101. When it goes up, the valve chamber 110 is isolated from the low-pressure path 102 because the top end portion thereof closes the low-pressure port 1102. In this manner, when the valve body 23 goes down, the back pressure chamber 106 communicates with the low-pressure path 102 via the out-orifice 108 and the valve chamber 110. As a result, the back pressure of the needle 21 is reduced and the needle 21 lifts from the seat. On the other hand, when the valve body 23 goes up, the back pressure chamber 106 is isolated from the low-pressure path 102 and communicates only with the high-pressure path 101. As a result, the back pressure of the needle 21 is raised and the needle 21 sits on the seat.

A pin portion 222 of a piston 22 which is located below the valve body 23 moves in the valve chamber 110, passes through the front of the high-pressure port 1101 and supports the valve body 23. A main body 221 of the piston 22 is retained slidably in the guide hole 122. A bottom end surface 22*a* of the piston 22 is in elastic contact with a spring 32 arranged in the spring chamber 109, and biases the valve body 23 upward. The spring force of the spring 32 is adjusted so that the valve body 23 can bring the low-pressure port 1102 into a closed state even when the common rail pressure is not raised high enough, that is, when the fuel pressure of the high-pressure port 1101 is not raised high enough. This is to prevent fuel from being injected by mistake.

As described above, the magnitude of the back pressure of the needle 21 is switched to another depending on the positions of the valve body 23, and this switching is carried out by the piezo actuator 1*c* which presses and drives the valve body 23.

The piezo actuator 1*c* comprises the piezo stack 5 and the like stored in the piezo stack chamber 112 and pistons 24 and 25 inserted into the guide hole 123.

In the piezo stack chamber 112, a disc member 41 and a spring 34 are housed below the piezo stack 5, which extends and contracts in the vertical direction and which is also housed in the piezo stack chamber 112. The disc member 41 has an O-ring 42 for sealing laid in the groove formed in all around the side surface thereof. The piezo stack chamber 112 communicates with the low-pressure path 102 below the disc member 41 so that the leakage in the sliding portion around the outer circumference of the large-diameter piston 25, which will be described later, flows back into the low-pressure path 102.

The guide hole 123 has a small-diameter lower portion 1231 and a large-diameter upper portion 1232, and the two pistons 24 and 25 with a different diameter are retained slidably therein. The piston 24 (referred to as a small-diameter piston hereinafter, when appropriate) retained in the guide hole small-diameter portion 1231 has a pin portion 242 which extrudes downward from a main body 241 and penetrates into the valve chamber 110 through the low-pressure port 1102, whereby the valve body 23 can be pressed downward.

The piston 25 (referred to as a large-diameter piston hereinafter, when appropriate) retained in the large-diameter portion 1232 of the guide hole 123 has a pin portion 252 which extrudes upward from a main body 251 and penetrates into the piezo stack chamber 112, thereby being opposed to the disc member 41. The pin portion 252 of the large-diameter piston is provided with a collar-shaped spring support 253 around the outer circumference thereof, and by the spring force of the spring 34 arranged below the spring support 253, the large-diameter piston 25 is biased upward, thereby the state of being in contact with the disc member 41 is maintained. As a result, the large-diameter piston 25 is displaced in the vertical direction by a distance equal to the displacement range of expansion and contraction of the piezo stack 5.

The space defined by the large-diameter piston 25 which is displaced in the vertical direction by a distance equal to the displacement range of expansion and contraction of the piezo stack 5, the small-diameter piston 24 at the lower part, and the guide hole 123 is filled with fuel, and serves as a displacement-enlarging chamber 111, and when the large-diameter piston 25 is displaced downward by the expansion of the piezo stack 5 and the fuel in the displacement-enlarging chamber 111 is compressed, the compression force is transmitted to the small-diameter piston 24 via the fuel in the displacement-enlarging chamber 111. As the diameter of the small-diameter piston 24 in contact with the valve body 23 is designed so as to be smaller than that of the large-diameter piston 25, the displacement of expansion of the piezo stack 5 is enlarged and converted into the displacement of the small-diameter piston 24, thereby the valve body 23 can be displaced downward so as to close the high-pressure port 1101.

A spring 33 is provided between the small-diameter piston 24 and the large-diameter piston 25 and a constant load is applied on an end surface 24*b* of the small-diameter piston 24. In this manner, a state in which the valve body 23 is retained by the small-diameter piston 24 and the piston 22 is always maintained.

When fuel is injected, first the piezo stack 5 is charged and the expansion of the piezo stack 5 causes the small-diameter piston 24 to lower to press down the valve body 23. Thereby, the valve body 23 opens the low-pressure port 1102 and, at the same time, closes the high-pressure port 1101, causing the back pressure chamber 106 to communicate with the low-pressure path 102, therefore, the fuel pressure in the back pressure chamber 106 is reduced. As a result, the force which acts on the needle 21 in the direction to cause the needle 21 to lift from the seat becomes preponderant over that which acts in the direction to cause the needle 21 to sit on the seat, thereby the needle 21 lifts from the seat and fuel injection is started.

When fuel injection is terminated, in contrast to the above, the piezo stack 5 is discharged to cause the piezo stack 5 to contract and the contraction of the piezo stack 5 cancels the force which presses the valve body 23 downward. At this time, the pressure inside the valve chamber 110 is low and a high pressure of fuel in the high-pressure port 1101 is exerted on the bottom end surface of the valve body 23, therefore, the upward fuel pressure is exerted on the valve body 23 on the whole. As the force which presses the valve body 23 downward is cancelled and the valve body 23 closes the low-pressure port 1102 again, causing a rise in fuel pressure in the valve chamber 110, the needle 121 sits on the seat and injection is terminated.

Next, the sliding structure in which the large-diameter piston 25 is retained in the guide hole large-diameter portion 1232 is explained below. The large-diameter piston 25 is designed so that the length of the main body 251, which is in slidable contact with a side surface 1232*a* of the guide hole large-diameter portion 1232, is slightly shorter than that of the guide hole large-diameter portion 1232 and, moreover, the length and the like of the large-diameter piston pin portion 252 is designed so that the large-diameter piston main body 251 remains within the guide hole large-diameter portion 1232 when the piezo stack 5 is in a state of expansion and a state of contraction. In other words, a side surface 25*c* of the large-diameter piston main body 251 is always in slidable contact with the side surface 1232*a* of the guide hole large-diameter portion 1232.

Figure 3:
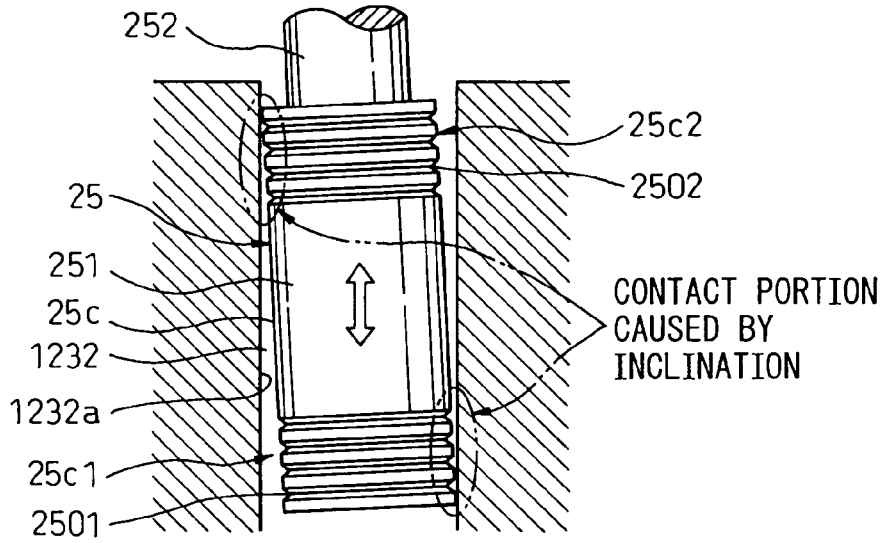
FIG. 3 is a diagram illustrating the effect of the present invention.

In both end portions 25*c*1 and 25*c*2 of the side surface 25*c* of the large-diameter piston main body 251, a plurality of labyrinth grooves 2501 and 2502 are formed by cutting, respectively. This will bring about the following effect. The pressing force of the piezo actuator 5 acts on an end surface 25*b*, which is one of the end faces of the large-diameter piston 25, and the spring force of the spring 33 as well as the fuel pressure in the displacement-enlarging chamber 111 acts on the other end surface 25*a* of the large-diameter piston 25. The status in which the large-diameter piston pin portion 252 comes into contact with the disc member 41, and the like, vary depending on the error in assembling the parts making up the injector or the aging of the parts, therefore, the two pressing forces which act on the large-diameter piston 25 in opposite directions are likely to become a couple and because of the couple, the large-diameter piston main body 251 inclines with respect to the axial direction of the guide hole large-diameter portion 1232, as shown in FIG. 3. In this case, as seen from the figure, the end portions 25*c*1 and 25*c*2 of the side surface 25*c* of the large-diameter piston main body 251 become the portion in contact with the side surface 1232*a* of the guide hole large-diameter portion 1232. At the contact portion, a large vertical reaction force is produced and abrasion is likely to increase. Here, the contact portion is not a point but a line in the axial direction, and the length of the contact portion in the axial direction is determined according to the working condition or the specification of the parts, such as the shape and material of the large-diameter piston main body 251, the two pressing forces, and the clearance between the side surface 25*c* of the large-diameter piston main body 251 and the side surface 1232*a* of the guide hole large-diameter portion.

In the present invention, the labyrinth grooves 2501 and 2502 are formed in the end portions 25*c*1 and 25*c*2 of the side surface 25*c* of the large-diameter piston main body 251, at which abrasion is likely to increase, therefore, it is possible to avoid the degradation in sealing ability caused by the formation of an excessive number of grooves in the center in the axial direction of the large-diameter piston main body 251 sandwiched by the end portions 25*c*1 and 25*c*2, and to effectively prevent abrasion at the contact portions caused by the lack of an oil film. It is also possible to avoid in advance the adhesion of the shaft member to the side wall of the guide hole due to the abrasion and the binding of the shaft member thereto due to the occurrence of abrasion powder.

If only one groove is formed in each of the end portions 25*c*1 and 25*c*2 of the side surface in order to cause the oil film to cover the entire contact portions, the width of the groove needs to be sufficiently wide, but in the present embodiment, the plurality of labyrinth grooves 2501 and 2502 are formed in each of the end portions 25*c*1 and 25*c*2 of the side surface, respectively, therefore, even though the total area of the grooves in each of the end portions 25*c*1 and 25*c*2 is small, it is possible to cause the oil film to cover the entire contact portion, thereby the oil film uniformly cover the contact portions in the axial direction of the hole. As a result, it is possible to realize a very high sealing ability while maintaining the oil film necessary for the contact portions.

Figure 4:
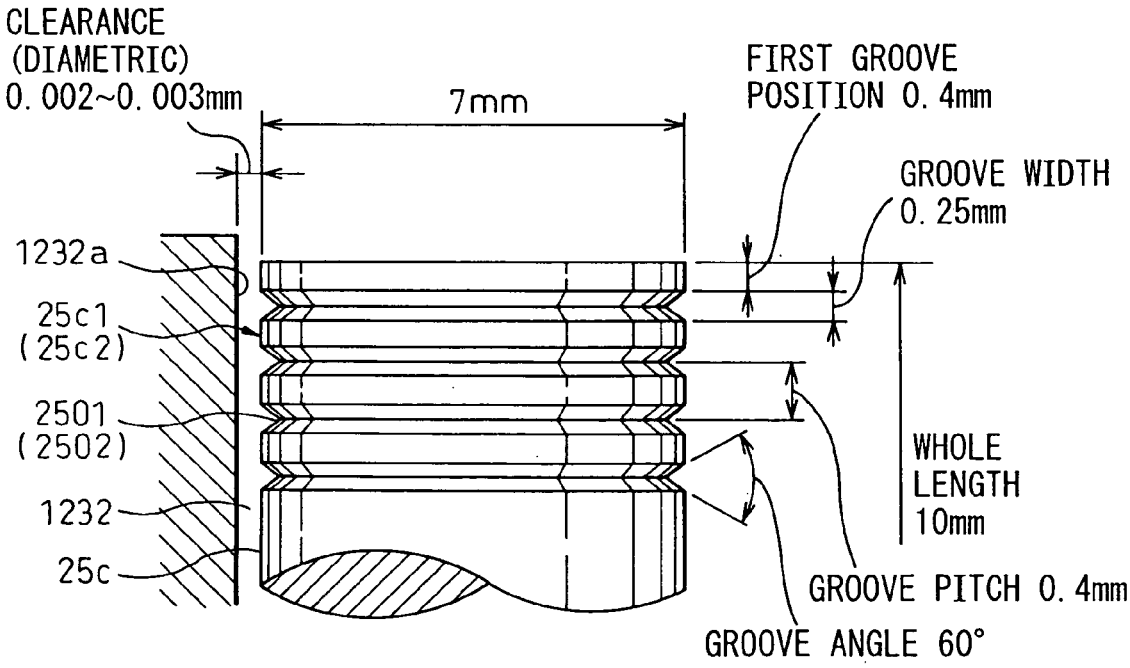
FIG. 4 is another enlarged view of the injector.

The labyrinth grooves 2501 and 2502 are formed, for example, as shown in FIG. 4, in fours in each of the end portions 25*c*1 and 25*c*2 of the side surface of the large-diameter piston large-diameter main body 251, with a total length of 10 mm and a diameter of 7 mm. The position of a first groove, which is nearest to the end of the large-diameter piston large-diameter main body 251, is at 0.4 mm from the end and the groove pitch is set to 0.4 mm. The groove width is 0.25 mm. The groove angle is 60°.

By setting the clearance between the side surface of the large-diameter piston main body 251 and the side surface 1232*a* of the guide hole large-diameter portion 1232 to 0.002 to 0.003 mm in this example, it was possible to realize a sufficient sealing ability and avoid the abrasion at the contact portions.

Next, the main parameters which must be taken into account when optimizing the specifications of the labyrinth grooves 2501 and 2502 are explained below.

<The Position of the First Groove from the End of the Large-Diameter Piston Main Body>

Figure 5:
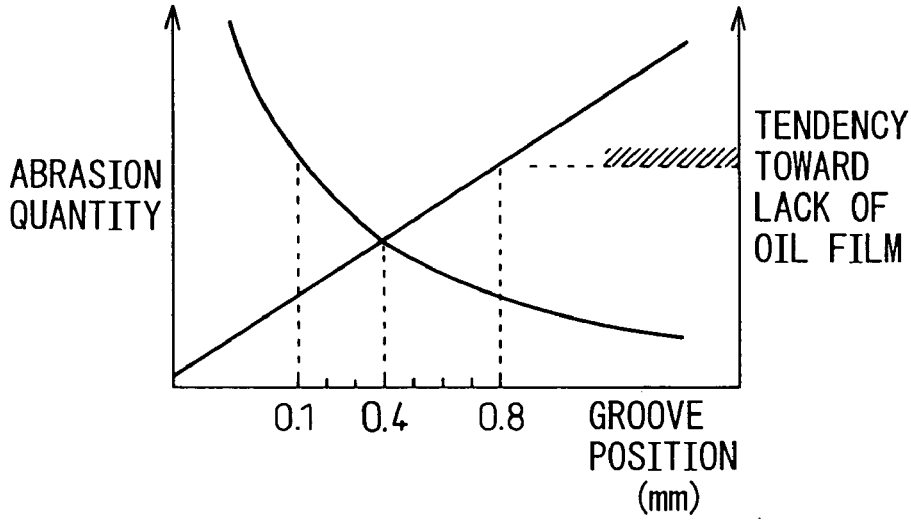
FIG. 5 is a first graph illustrating the setting of main specifications of the injector.

FIG. 5 shows relationships between the groove position and the quantity of abrasion, and between the groove position and the tendency toward the lack of an oil film. When the groove position is near the end, the first groove communicates with the fuel filling section above or below the large-diameter piston main body 251 because of the increase of abrasion and therefore the effect of the labyrinth is reduced, resulting in further increase of abrasion. On the other hand, when the groove position is far from the end, the length of the area between the end and the first groove in which no groove is formed is long and the lack of an oil film is more likely to occur. Therefore, the position of the first groove should be adjusted so as to fall within the allowable range of two conditions, i.e., the quantity of abrasion and the tendency toward the lack of an oil film, with the both condition being taken into account. Among the numerals below the horizontal axis, a numeral in thick letters is one used in the embodiment, and other numerals in thin letters are the allowable threshold values for each condition (this is applicable to the following explanation). The figure shows that the groove position needs to be 0.1 (mm) or more when the quantity of abrasion is taken into account, and the groove position needs to be 0.8 (mm) or less when the tendency toward the lack of an oil film is taken into account. The tendency toward the lack of an oil film can be represented by the quantity of the oil film attached to the side surface of the large-diameter piston main body after a prescribed number of times of the axial movements of the shaft member.

<Groove Pitch>

Figure 6:
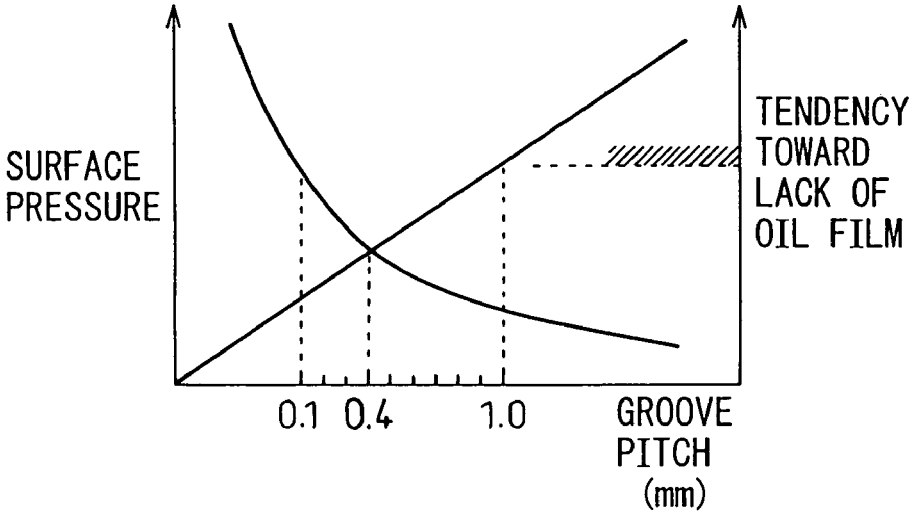
FIG. 6 is a second graph illustrating the setting of main specifications of the injector.

FIG. 6 shows a relationship between the groove pitch and the surface pressure, and between the groove pitch and the tendency toward the lack of an oil film. When the groove pitch is large, the length of the area in which no groove is formed is long and the surface pressure is reduced, thereby the lack of an oil film is more likely to occur. Therefore, the groove pitch should be adjusted so as to fall within the allowable range of two conditions, i.e., the surface pressure and the tendency toward the lack of an oil film, with the two conditions being taken into account.

<Number of Grooves>

Figure 7:
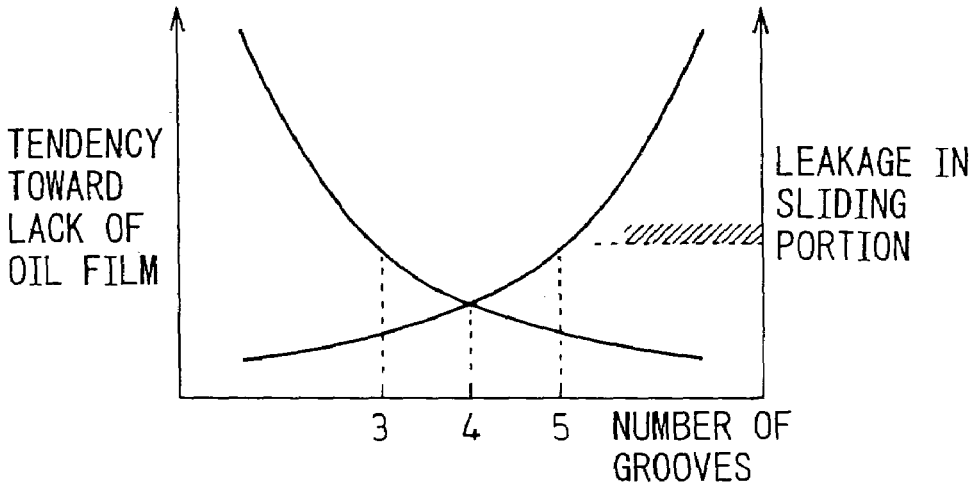
FIG. 7 is a third graph illustrating the setting of main specifications of the injector.

FIG. 7 shows a relationship between the number of grooves and the tendency toward the lack of an oil film, and between the number of grooves and the leakage in the sliding portion. When the number of grooves is small, the length of the area in which no groove is formed is long and the lack of an oil film is more likely to occur. On the other hand, when the number of grooves is large, the lack of an oil film is more unlikely to occur but the sealing ability is degraded and the leakage in the sliding portion increases. Therefore, the number of grooves should be adjusted so as to fall within the allowable range of two conditions, i.e., the tendency toward the lack of an oil film and the leakage in the sliding portion, with the both conditions being taken into account.

<Groove Width>

Figure 8:
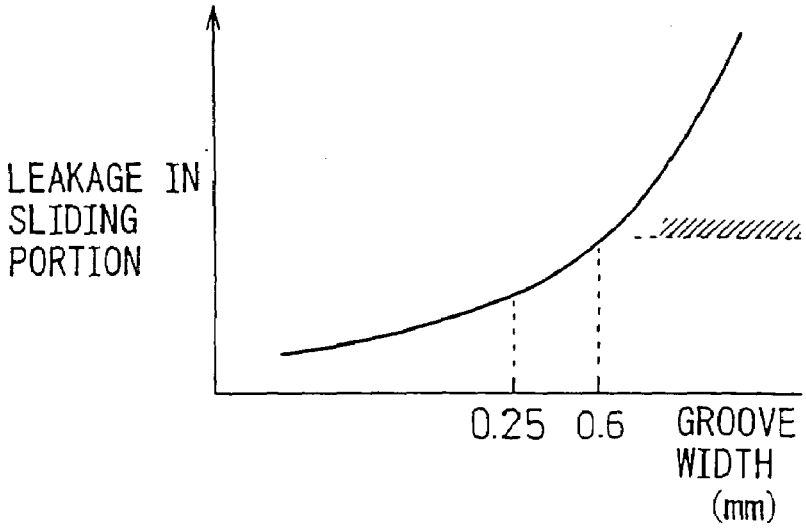
FIG. 8 is a fourth graph illustrating the setting of main specifications of the injector.

FIG. 8 shows a relationship between the groove width and the leakage in the sliding portion. When the groove width is large, the sealing ability is degraded accordingly, therefore, the groove width should be adjusted so as to fall below the allowable upper limit. In addition, the groove width depends on the groove angle therefore the graph shown in FIG. 8 shows a similar tendency when the groove width is replaced with the groove angle. Therefore, it is also possible to adjust the groove angle so as to fall below the allowable upper limit.

As described above, the area of the contact portions is defined according to the load which acts on the large-diameter piston 25 in the axial direction of pressing, the shape of the large-diameter piston 25, etc., and a plurality of labyrinth grooves are formed substantially within the area, but the position of the first groove, the groove pitch, the number of grooves and the groove width are related to each another and when any one of these variables is determined, the allowable values for the rest of the variables are limited. Therefore, the ranges of values available for these variables should be adjusted, with the range of the above-mentioned contact portion being taken into account. In this case, it is needless to say that these variables need not be determined in order according to the above-mentioned graphs.

Although the labyrinth grooves are formed only in both end portions of the side surface of the large-diameter piston main body in the present embodiment, it is of course possible to form the labyrinth grooves in the area sandwiched by both end portions according to the circumstances while taking into account the required sealing ability.

Moreover, in the present embodiment, the length of the large-diameter piston is designed so as to be shorter than the that of the guide hole large-diameter portion by more than a prescribed length so that the large-diameter piston main body remains in the area between both ends of the guide hole large-diameter portion when the large-diameter piston is displaced in the range of displacement thereof, therefore, the side surface of the large-diameter piston is always in slidable contact with the side surface of the guide hole large-diameter portion. Therefore, both end portions of the side surface of the large-diameter piston main body are the contact portions, and a plurality of labyrinth grooves are formed therein. In contrast to this, when both end portions of the side surface of the large-diameter piston main body is not always in slidable contact with the side surface of the guide hole large-diameter portion, such as when the large-diameter piston main body is longer than the guide hole large-diameter portion, a plurality of labyrinth grooves are formed in each of both end portion in the axial direction of the area, which is always in slidable contact with the side surface of the guide hole large-diameter portion, of the side surface of the large-diameter piston main body. The areas of the end portions in which the labyrinth grooves are to be formed are substantially the contact areas determined by a preliminary experiment or the like.

The present invention may also be applied to a sliding structure in which the guide hole small-diameter portion 1231 retains the small-diameter piston 24, in addition to the large-diameter piston 25, a sliding structure in which the guide hole 121 retains the needle proximal end portion 211, and a sliding structure in which the guide hole 122 retains the piston main body 221.

The present invention can be preferably applied to a sliding structure in which a needle, which is a shaft member, is slidably retained in a guide hole, even though an injector has a structure which has a spring for biasing the needle in a direction to open a valve, and in which the needle opens the valve when a fuel pressure which acts on the needle in a direction to open the valve exceeds a valve open pressure defined by the spring force of the spring.

In addition to a sliding structure of a shaft member in an injector, the present invention may be widely applied to a structure as long as it has a sliding structure in which a guide hole retains a shaft member and a load is applied to both end surfaces of the shaft member in a direction in which the shaft member is pressed.

While the invention has been described by reference to specific embodiments chosen for the purposes of illustration, it should be apparent that numerous modifications could be made thereto by those skilled in the art without departing from the basic concept and scope of the invention.

The invention claimed is:

1. A sliding structure of a shaft member in which a shaft member is retained slidably in a guide hole, wherein a plurality of labyrinth grooves are formed in both axial end portions of the side surface of the shaft member which are located in an area, which are always in slidable contact with a side surface of the guide hole, wherein an intermediate portion of the shaft member between said axial end portions has a substantially constant outer diameter that is free of grooves, and wherein a distance between an end of the shaft member and a first groove of the labyrinth grooves nearest to the end of the shaft member is 0.1 to 0.8 mm.

2. An injector having a needle which is inserted into a nozzle supplied with a fuel for injection, is made up of a shaft member retained slidably in a guide hole formed in the nozzle wall and displaced in the axial direction to switch between fuel injection and termination of fuel injection;

wherein a plurality of labyrinth grooves are formed in both axial end portions of the side surface of the shaft member which are located in an area, which are always in slidable contact with a side surface of the guide hole, wherein an intermediate portion of the shaft member between said axial end portions has a substantially constant outer diameter that is free of grooves, and wherein a distance between an end of the shaft member and a first groove of the labyrinth grooves nearest to the end of the shaft member is 0.1 to 0.8 mm.

3. The sliding structure as set forth in claim 1, wherein a groove pitch of the labyrinth grooves is 0.1 to 1.0 mm.

4. The sliding structure as set forth in claim 1, wherein the number of the labyrinth grooves at each end portion is 3 to 5.

5. The sliding structure as set forth in claim 1, wherein a groove width of the labyrinth grooves is equal to or less than 0.6 mm.

6. The sliding structure as set forth in claim 1, wherein said intermediate portion has an axial length greater than an axial length of either of said grooved axial end portions.

7. The injector as set forth in claim 2, wherein a groove pitch of the labyrinth grooves is 0.1 to 1.0 mm.

8. The injector as set forth in claim 2, wherein the number of the labyrinth grooves at each end portion is 3 to 5.

9. The injector as set forth in claim 2, wherein a groove width of the labyrinth grooves is equal to or less than 0.6 mm.

10. The injector as set forth in claim 2, wherein said intermediate portion has an axial length greater than an axial length of either of said grooved axial end portions.

11. An injector having a needle, which is inserted into a nozzle supplied with a fuel for injection and is displaced in the axial direction to switch between fuel injection and termination of fuel injection, a valve chamber provided with a valve body for isolating a back pressure chamber from a low-pressure source provided in a low-pressure flow path for releasing to the low-pressure source fuel in the back pressure chamber, to which a high-pressure fuel is supplied and which generates a back pressure of the needle, and a piston, which is made up of a shaft member that presses against the valve body, and is retained slidably in a guide hole, wherein a plurality of labyrinth grooves are formed in both axial end portions of the side surface of the shaft member which are located in an area, which are always in slidable contact with a side surface of the guide hole, and wherein an intermediate portion of the shaft member between said axial end portions has a substantially constant outer diameter that is free of grooves, and wherein a distance between an end of the shaft member and a first groove of the labyrinth grooves nearest to the end of the shaft member is 0.1 to 0.8 mm.

12. The injector as set forth in claim 11, wherein a groove pitch of the labyrinth grooves is 0.1 to 1.0 mm.

13. The injector as set forth in claim 11, wherein the number of the labyrinth grooves at each end portion is 3 to 5.

14. The injector structure as set forth in claim 11, wherein a groove width of the labyrinth grooves is equal to or less than 0.6 mm.

15. The injector as set forth in claim 11, wherein said intermediate portion has an axial length greater than an axial length of either of said grooved axial end portions.

* * * * *